US007632105B2

(12) United States Patent
Yan

(10) Patent No.: US 7,632,105 B2
(45) Date of Patent: Dec. 15, 2009

(54) LAND GRID ARRAY CONNECTOR HAVING IMPROVED CONTACT

(75) Inventor: Liang-Yong Yan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 17 days.

(21) Appl. No.: 11/986,459

(22) Filed: Nov. 21, 2007

(65) Prior Publication Data

US 2008/0119063 A1 May 22, 2008

(30) Foreign Application Priority Data

Nov. 21, 2006 (CN) ..... 2006 2 0125764 U

(51) Int. Cl.
*H01R 12/00* (2006.01)

(52) U.S. Cl. ..... 439/66; 439/862

(58) Field of Classification Search ..... 439/66, 439/733.1, 862

See application file for complete search history.

(56) References Cited

U.S. PATENT DOCUMENTS 4,555,153 A * 11/1985 Bricaud et al. ..... 439/71
4,857,001 A * 8/1989 Nakano et al. ..... 439/68
5,685,748 A * 11/1997 Harting et al. ..... 439/862
6,976,888 B2 12/2005 Shirai et al.

* cited by examiner

*Primary Examiner*—Tho D Ta
*Assistant Examiner*—Travis Chambers
(74) *Attorney, Agent, or Firm*—Ming Chieh Chang; Wei Te Chung; Andrew C. Cheng

(57) ABSTRACT

An LGA connector (100) includes a housing (2) and a number of contacts (1) received in the housing. Each contact has a base plate (10), a connecting portion (9) extending from a side of the base plate and a resilient contacting portion (93) projecting from the connecting portion. An elastic plate (11) extends from the base plate and has a spring arm (120) disposed at one side thereof. A curved receiving space (130) is formed between the spring arm and the elastic plate. The contact has a board terminal (12) extending from a lower end of the elastic plate for connecting to a printed circuit board.

15 Claims, 3 Drawing Sheets

LAND GRID ARRAY CONNECTOR HAVING IMPROVED CONTACT

BACKGROUND OF THE INVENTION

1. Field of the Invention

The present invention is directed to an art of a land grid array (LGA) contact used in an LGA connector for electrically connecting to a printed circuit board (PCB).

2. Description of Prior Arts

U.S. Pat. No. 6,976,888 issued on Dec. 20, 2005 discloses a plurality of LGA contacts for electrically bridging two electrical interfaces such as a Land Grid Package (LGP) and a printed circuit board (PCB). The LGA connector has a housing defining a plurality of passageways therethrough and a plurality of contacts received in the passageways. The LGA contact includes a substantially rectangular base plate and a plurality of anchoring projections formed on each side wall of the base plate for interfering with the inner wall of the passageway. The LGA contact has a pair of elastic plates extending upwardly from an upper end of the base plate and a slit defined between the elastic plates. A resilient contact extends from an upper end of one elastic plate and comprises a contact portion for contacting with the LGP. A solder ball attachment paddle (board terminal) is disposed in a lower edge of the base plate for coupling with the PCB.

During assembly, the contact is inserted into the passageway of the housing and the number of anchoring projections of the base plate interfere with the inner wall of the passageway. However, the base plate of the contact described above could not provide sufficient resilient force for firmly engaging with the passageway of the housing.

Hence, it is desirable to provide an improved land grid array connector to overcome the aforementioned disadvantages.

SUMMARY OF THE INVENTION

An object of the present invention is to provide an LGA connector having a number of LGA resilient contacts having an elastic plate for flexibly and firmly engaging with corresponding passageways of a housing of the LGA.

To achieve the above object, a land grid array connector having a plurality of contacts and a housing defining a plurality of passages therein for receiving the contacts. The contact has a base plate, a connecting portion connected to a side of the base plate, a resilient contacting portion extending upwardly obliquely from the connecting portion and projecting out of the passage. The contact comprises an elastic plate having a spring arm disposed at one side of the elastic plate and a board terminal extending from a lower end of the elastic plate for connecting to the printed circuit board (not shown). The contact further comprises a curved receiving space formed between the spring arm and the elastic plate.

Advantages of the present invention are to provide a contact having a spring arm disposed at one side of the elastic plate. During assembly, the spring arm flexibly engages with the passageway of the housing, and finally resists against the passageway firmly.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
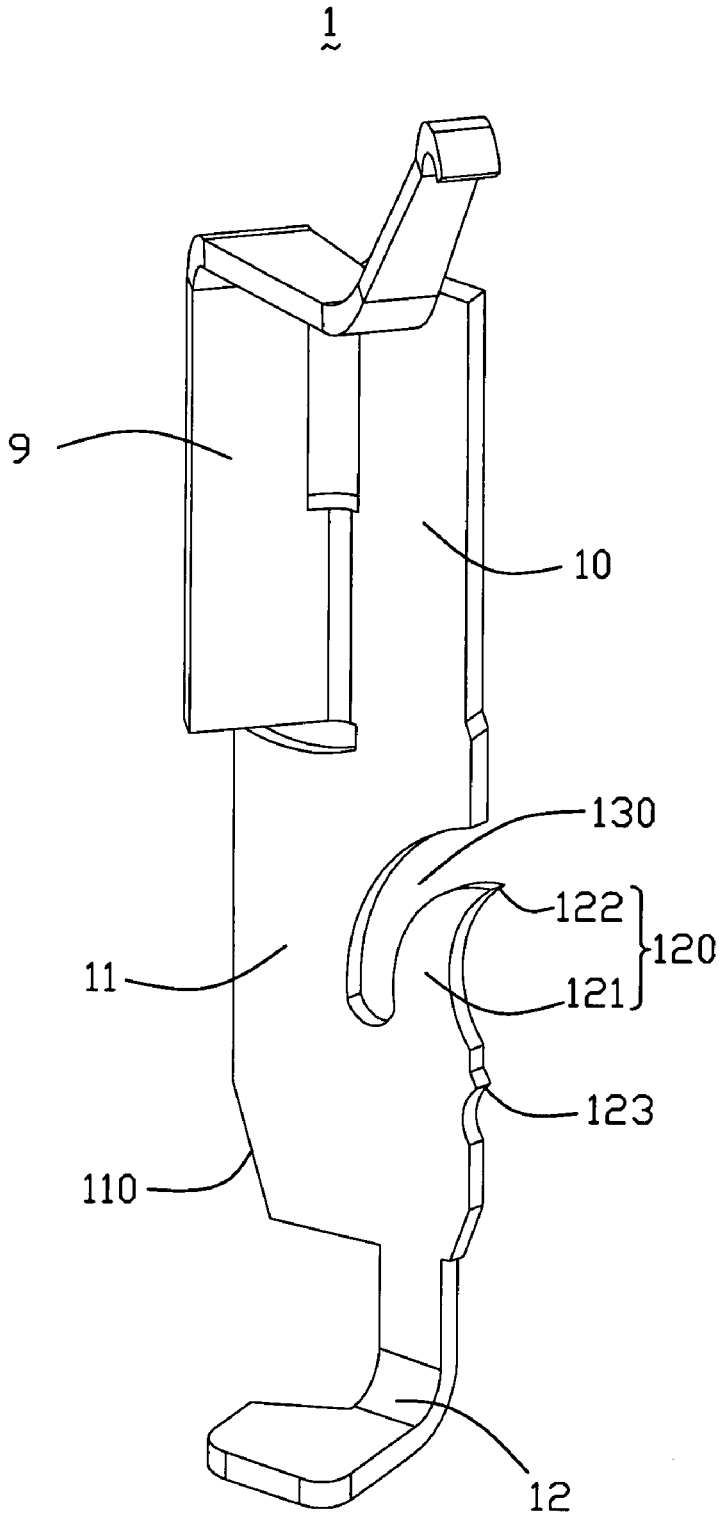
FIG. 1 is a perspective view of a contact of a land grid array connector of the present invention.
Figure 2:
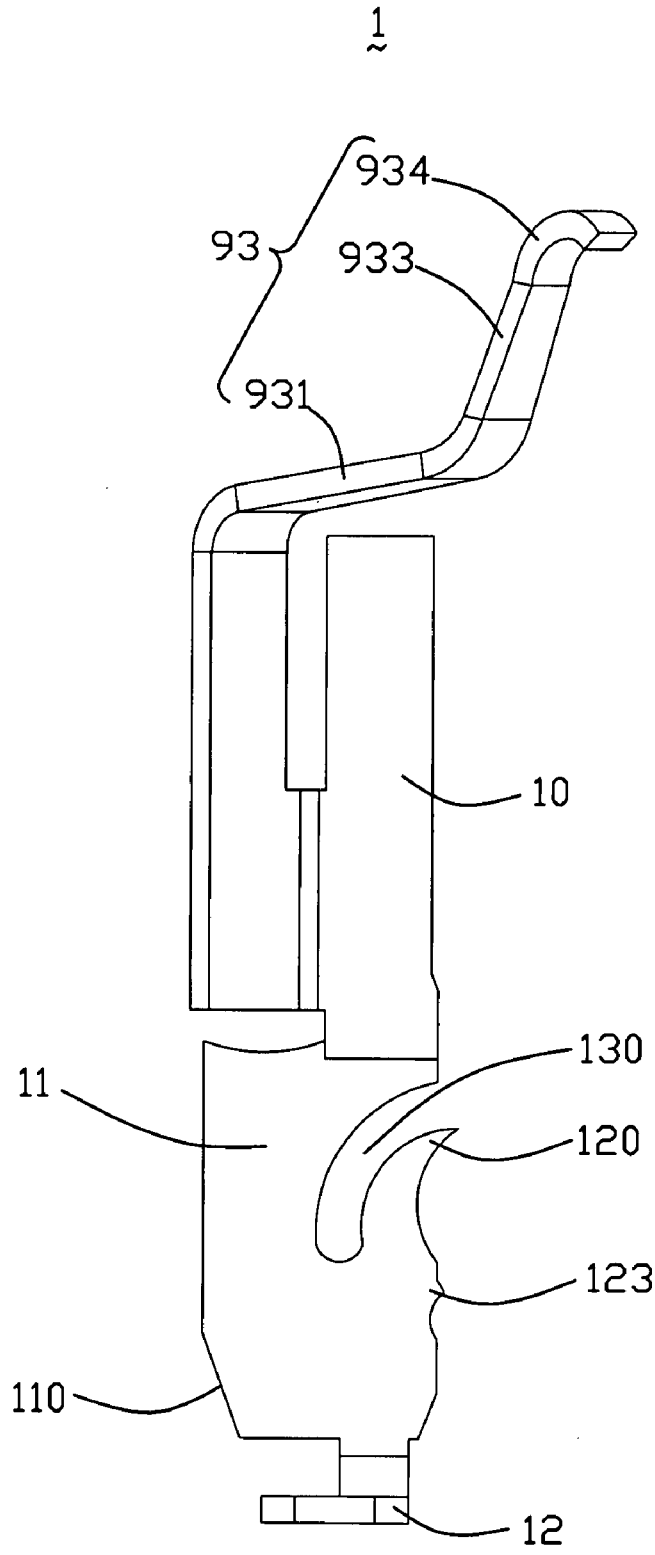
FIG. 2 is a perspective view similar to FIG. 1, taken from another aspect.
Figure 3:
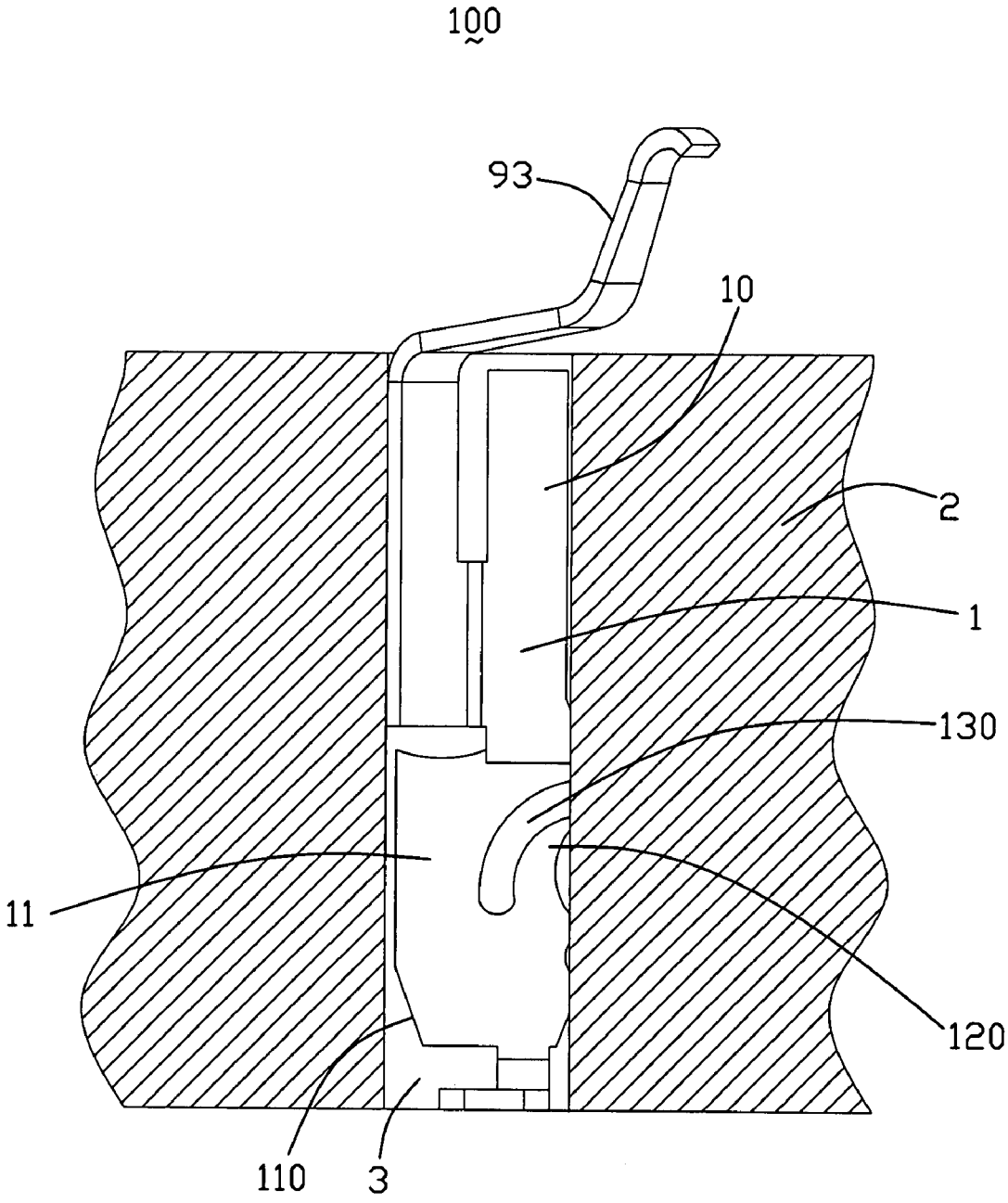
FIG. 3 is a perspective view of the contact assembled to a housing of the land grid array connector.

Reference will now be made to the drawing figures to describe the present invention in detail. Referring to FIGS. 1-3, a land grid array connector 100 in accordance with the embodiment of the present invention comprises a housing 2 having a plurality of passageways (not labeled) defined therein and a plurality of contacts 1 respectively received within the corresponding passageway.

The contact 1 has a base plate 10, an elastic plate 11 extending from the base plate 10 and a board terminal 12 extending from a lower end of the elastic plate 11 for connecting to a printed circuit board (not shown). The elastic plate 11 comprises a spring arm 120 disposed at one side thereof. The contact 1 further has a curved receiving space 130 defined between the spring arm 120 and the elastic plate 11. The spring arm 120 is of crescent configuration and comprises an arced portion 121 and a tip portion 122 extending out of the end of the arced portion 121 for resisting against the inner surface of the passageway of the housing 2. A guiding face 110 is located at a lower side of the elastic plate 11. The elastic plate 11 further has a plurality of bards 123 extending out of the edge portion thereof for coupling with the passageway of the housing 2. In another embodiment, the bards 123 are disposed at an edge portion of the spring arm 120 for firmly coupling with the inner surface of the passageway.

The contact 1 further comprises a connecting portion 9 and a resilient contacting portion 93 projecting outwardly from the passageway of the housing 2 for contacting with a contact pad (not shown) formed on an IC package. The resilient contacting portion 93 is angular relative to the base plate 10. The resilient contacting portion 93 has a first bending portion 931 perpendicularly bending from the connecting portion 9, a second bending portion 933 extending upwardly from the first bending portion 931 and a contacting portion 934 disposed at the end of the second bending portion 933 for contacting with the contact pad.

In assembly, the contact 1 is inserted into the passageway of the housing 2 in a top-to-bottom direction via the guiding face 110. The spring arm 120 of the elastic plate 11 has an inward deformation for easing insertion of the contact 1. When the contact 1 is absolutely received in the passageway, the spring arm 120 restores itself to a normal state and the tip portion 122 of the spring arm 120 resists against the inner surface of the passageway firmly. At that time, the number of the bards 123 are interfered with the passageways of the housing. The curved receiving space 130 is provided for receiving the chippings produced between the contact 1 and the passageway during the process of assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A land grid array connector for connecting to a printed circuit board, comprising:

a housing having a plurality of passageways defined therein; and a plurality of contacts respectively received within the corresponding passageways, each contact comprising:

a base plate;

a connecting portion connected to a side of the base plate;

a resilient contacting portion extending upwardly obliquely from the connection portion and projecting out of the passageway;

an elastic plate extending from the base plate and comprising a side retention edge having there along a spring arm and a second barb section piercing into the housing;

a curved receiving space formed around the spring arm so as to allow the spring arm more flexible than the second barb section; and a board terminal extending from a lower end of the elastic plate for connecting to the printed circuit board.

2. The land grid array connector as claimed in claim 1, wherein said spring arm is of crescent configuration and comprises an arced portion and a tip portion extending out of the end of the arced portion for resisting against the inner surface of the passageway of the housing.

3. The land grid array connector as claimed in claim 1, wherein said elastic plate has a plurality of bards extending out of an edge portion of the second barb section for coupling with the housing.

4. The land grid array connector as claimed in claim 1, wherein said elastic plate has a guiding face formed at a lower end thereof.

5. The land grid array connector as claimed in claim 1, wherein said connecting portion is angular relative to the base plate.

6. The land grid array connector as claimed in claim 1, wherein said resilient contacting portion has a first bending portion perpendicularly bending from the connecting portion, a second bending portion extending upwardly from the first bending portion and a contacting portion disposed at the end of the second bending portion.

7. An electrical connector comprising:

an insulative housing defining opposite first and second faces with at least one passageway extending therebetween and through the housing; and an electrical contact inserted into the housing along an insertion direction from the first face to the second face, said contact including a contacting portion, a soldering portion and a retention section therebetween;

said retention section defining a side retention edge having therealong spaced first and second barb sections piercing into the housing under a condition that the first barb section is closer to the first face than the second barb section and the second barb section is closer to the second face than the first barb section, said retention section further forming a first cutout between said first and second barb sections so as to receive chips derived from scraping due to at least one of the first barb section and the second barb section during insertion the contact into the passageway; wherein said retention section further forms a second cutout is around said first barb section so as to allow said barb section more flexible than the second barb section.

8. The electrical connector as claimed in claim 7, wherein said first barb section is configured to result in a resistance force when the contact is withdrawn from the passageway along a direction opposite to said insertion direction, larger than another resistance force when the contact is inserted into the passageway along the insertion direction.

9. The electrical connector as claimed in claim 7, wherein said second cutout is curved.

10. The electrical connector as claimed in claim 7, wherein an interference between the first barb section and the housing is greater than that between the second barb section and the housing.

11. The electrical connector as claimed in claim 7, said first cutout is smaller than the second cutout.

12. The electrical connector as claimed in claim 7, wherein said soldering portion is close to the side retention edge than the other side edge opposite to the side retention edge.

13. The electrical connector as claimed in claim 7, wherein along said side retention edge, said retention section further forms a third cutout beside second bard section opposite to said first cutout.

14. The electrical connector as claimed in claim 13, wherein said third cutout is smaller than the second cutout.

15. An electrical connector comprising:

an insulative housing defining opposite first and second faces with at least one passageway extending therebetween and through the housing; and an electrical contact inserted into the housing along an insertion direction from the first face to the second face, said contact including a contacting portion, a soldering portion and a retention section therebetween;

said retention section defining a side retention edge having a barb section piercing into the housing; wherein said retention section forms a curved cutout round said barb section to provide said barb section with flexibility under a condition that said barb section is configured to result in a resistance force when the contact is withdrawn from the passageway along a direction opposite to said insertion direction, larger than another resistance force when the contact is inserted into the passageway along the insertion direction.

* * * * *